US005906433A

United States Patent [19]

Mazzalveri

[11] Patent Number: 5,906,433

[45] Date of Patent: May 25, 1999

[54] MIXER FOR PRODUCTS GENERALLY DISPOSED IN CONTAINERS AND A UNIT PARTICULARLY ADAPTABLE TO THE MIXER, FOR SUPPORTING AND CLAMPING AT LEAST ONE OF THE CONTAINERS

[75] Inventor: Leopoldo Mazzalveri, Urbino, Italy

[73] Assignee: Corob S.r.l., Medolla, Italy

[21] Appl. No.: 08/887,125

[22] Filed: Jul. 2, 1997

Related U.S. Application Data

[63] Continuation of application No. 08/540,957, Oct. 11, 1995, abandoned.

[30] Foreign Application Priority Data

Oct. 11, 1994 [IT] Italy ..... BO940169 U

[51] Int. Cl.[6] ..... B01F 11/00

[52] U.S. Cl. ..... 366/209; 366/605

[58] Field of Search ..... 366/110, 111, 366/208–214, 216, 217, 219, 605

[56] References Cited

U.S. PATENT DOCUMENTS

| | | | |
|---|---|---|---|
| 2,022,526 | 11/1935 | Schletz | 366/211 |
| 2,022,527 | 11/1935 | Schletz . | |
| 2,034,902 | 3/1936 | Heinze | 366/209 |
| 2,151,123 | 3/1939 | Lavine | 366/211 |
| 3,706,443 | 12/1972 | Oberhauser . | |
| 3,880,408 | 4/1975 | Karjalainen . | |
| 3,943,844 | 3/1976 | Standbridge et al. . | |
| 4,004,784 | 1/1977 | Distler . | |
| 4,134,689 | 1/1979 | Ahrenskou-Sorensen . | |
| 4,235,553 | 11/1980 | Gall . | |
| 4,445,782 | 5/1984 | Sparrow, Jr. . | |
| 4,497,581 | 2/1985 | Miller . | |
| 4,588,302 | 5/1986 | Pizzi et al. . | |
| 4,789,245 | 12/1988 | Morbeck . | |
| 4,834,548 | 5/1989 | Tempel et al. . | |
| 4,842,415 | 6/1989 | Cane et al. . | |
| 5,035,601 | 7/1991 | Lin . | |
| 5,066,136 | 11/1991 | Johnson . | |
| 5,121,991 | 6/1992 | Wakatake . | |
| 5,197,802 | 3/1993 | Miller et al. . | |
| 5,261,744 | 11/1993 | Brunn . | |
| 5,268,620 | 12/1993 | Hellenberg . | |
| 5,310,257 | 5/1994 | Altieri, Jr. et al. | 366/217 X |
| 5,443,314 | 8/1995 | Gatlin | 366/111 X |
| 5,458,416 | 10/1995 | Edwards et al. | 366/209 |
| 5,462,353 | 10/1995 | Gatlin | 366/209 |

FOREIGN PATENT DOCUMENTS

| | | |
|---|---|---|
| 0093091 | 11/1983 | European Pat. Off. . |
| 0317112 | 5/1989 | European Pat. Off. . |
| 0587085 | 3/1994 | European Pat. Off. . |
| 0617998 | 10/1994 | European Pat. Off. . |
| 0631810 | 1/1995 | European Pat. Off. . |
| 1080072 | 4/1960 | Germany . |
| 2819833 | 11/1978 | Germany . |
| 2725080 | 12/1978 | Germany . |
| 2809513 | 9/1979 | Germany . |
| 9206841 | 8/1992 | Germany . |
| 9307761 | 8/1993 | Germany . |
| 9320352 | 6/1994 | Germany . |
| 9407810 | 7/1994 | Germany . |
| 1310655 | 3/1973 | United Kingdom . |
| 2192138 | 1/1988 | United Kingdom . |
| WO9108045 | 6/1991 | WIPO . |

*Primary Examiner*—Charles E. Cooley
*Attorney, Agent, or Firm*—Sughrue, Mion, Zinn, Macpeak & Seas, PLLC

[57] ABSTRACT

A mixer for products generally disposed in containers, such as, for example, varnishes, paints and the like, comprises a support structure to which a unit, generally movable selectively along a predetermined path, for supporting and clamping at least one container, is connected. The support unit comprises two clamping plates which are mounted on linear sliding guides and are rotatable about a common vertical axis in the operative condition. A plurality of idle wheels roll along an annular path on a surface of each plate in order to withstand loads perpendicular to the plates. The upper support plate can be driven along an axis parallel to the common axis by means of driving screws and is mounted on linear sliding guides and the lower support plate is slidable selectively along an axis perpendicular to the common axis.

9 Claims, 2 Drawing Sheets

MIXER FOR PRODUCTS GENERALLY DISPOSED IN CONTAINERS AND A UNIT PARTICULARLY ADAPTABLE TO THE MIXER, FOR SUPPORTING AND CLAMPING AT LEAST ONE OF THE CONTAINERS

This is a Continuation of application Ser. No. 08/540,957 filed Oct. 11, 1995 now abandoned.

BACKGROUND OF THE INVENTION

The present invention relates to the field of mixers for fluids.

In particular, the present invention has been developed with reference to a mixer for fluids disposed in containers, of the so-called vibration type in which an inner frame which supports the container is set in oscillating motion along a predetermined path relative to the outer frame.

A vibration mixer of the known type indicated above is described in GB-1 310 655. Although this mixer has basic components for bringing about a vibratory mixing motion, it is bulky and not easy for an operator to use since it has means for clamping the container, consisting of a manually-operated driving screw which does not permit precise detection of the force with which the container is clamped on the machine. Moreover, the container has to be positioned in the machine manually and this operation may be difficult or onerous if not impossible, particularly with large or heavy containers. Moreover, the machine of the prior art has no protection or safety systems for protecting the operator during mixing operations, particularly when the movement of large and heavy containers gives rise to large forces and moments of inertia.

Another type of vibration mixer is described in the Applicant's European patent EP-0 617 998. This mixer is considerably improved in comparison with previously known mixers both from the point of view of mixing efficiency and as regards bulk, ease of use and the protection and safety of the operator.

However, the increasing need for mixing machines which are reliable, efficient and easy to use and maintain has led to a search for solutions to problems the awareness of which is greater and greater in the field.

U.S. Pat. No. 4,134,689 describes a mixing machine comprising a unit for clamping fluid containers in which two opposed clamping plates are opened and closed by the rotation of two vertical driving screws. During the mixing motion, the forces and moments of inertia generated by the mass of the container and of the fluids contained therein are discharged to the driving screws. This situation has two consequences: on the one hand, the continual stressing of the threads of the driving screws leads to rapid wear thereof and to an increase in play such as to render the reliability of the clamping of the container unacceptable and make it necessary to repair or replace the screws frequently and, on the other hand, bending of the driving screws, which is not preventable beforehand, takes place during the vibratory motion of the mixer, and, as well as rendering the methods of controlling the clamping force unreliable, necessitates the provision of oversized screws with the application of high safety factors to take account of unknown stresses. In any case, the bending stress on the driving screws is also undesirable because the flexural strength of the driving screws is reduced both by the accompanying tensile stresses due to the clamping of the container and by the presence of the threads which generate localized stresses which may reach very high levels.

In some mixing machines of known type it is possible to remove the lower plate at least partially to facilitate the loading of the container into the machine and its unloading therefrom. The systems currently used are not very reliable, however, since, on the one hand, an increase in the play of the members for ensuring the sliding of the lower support plate of the container is easily brought about with consequent adverse effects on the control of the clamping force of the container in operative conditions, on the other hand, sediments, fluid particles or, in any case, deposits may block the normal movement to extract the plate.

SUMMARY OF THE INVENTION

The object of the present invention is to overcome the disadvantages of the prior art by providing a mixing machine which is reliable over time even after heavy use and which, at the same time, is easy and convenient for an operator to use.

A further object of the present invention is to provide a mixing machine the structural elements of which can be given the correct dimensions at the design stage, reducing to a minimum the uncertainty regarding the ability of these elements to withstand the often heavy stresses to which they are subjected in use.

In order to achieve the objects indicated above, the present invention relates to a A mixer for products generally disposed in a container, said mixer comprising a support structure, wherein the mixer comprises holding means associated with the support structure and able to move along a predetermined path, the holding means including:

first and second opposed clamping members which can clamp at least one of the container, at least one of said clamping members being movable selectively from a first, loading position in which the at least one container can be placed on the holding means, to a second, operative position, actuator means for selectively bringing about the movement of said at least one clamping member from the first position to the second position and vice versa, and guide means distinct from the actuator means for guiding the linear sliding of the at least one clamping member along a predetermined axis during its movement from the first position to the second position and for reacting to forces oriented in directions other than along the predetermined axis.

The present invention also relates to A support and clamping unit for a machine for handling containers of products, wherein said support and clamping unit comprises holding means including:

at least first and second opposed clamping members which can clamp at least one of the containers, at least one of the first and second clamping members being movable selectively from a first, loading position in which the at least one container can be placed on the holding means, to a second, operative position, actuator means for selectively bringing about the movement of the at least one clamping member from the first position to the second position and vice versa, and guide means distinct from the actuator means for guiding the linear sliding of the at least one clamping member along a predetermined axis during its movement from the first position to the second position and for reacting to forces oriented in directions other than along the predetermined axis.

BRIEF DESCRIPTION OF THE DRAWINGS

Further characteristics and advantages of the present invention will become clear from the detailed description which follows with reference to the appended drawings, given purely by way of non-limiting example, in which.

DETAILED DESCRIPTION OF THE INVENTION

Figure 1:
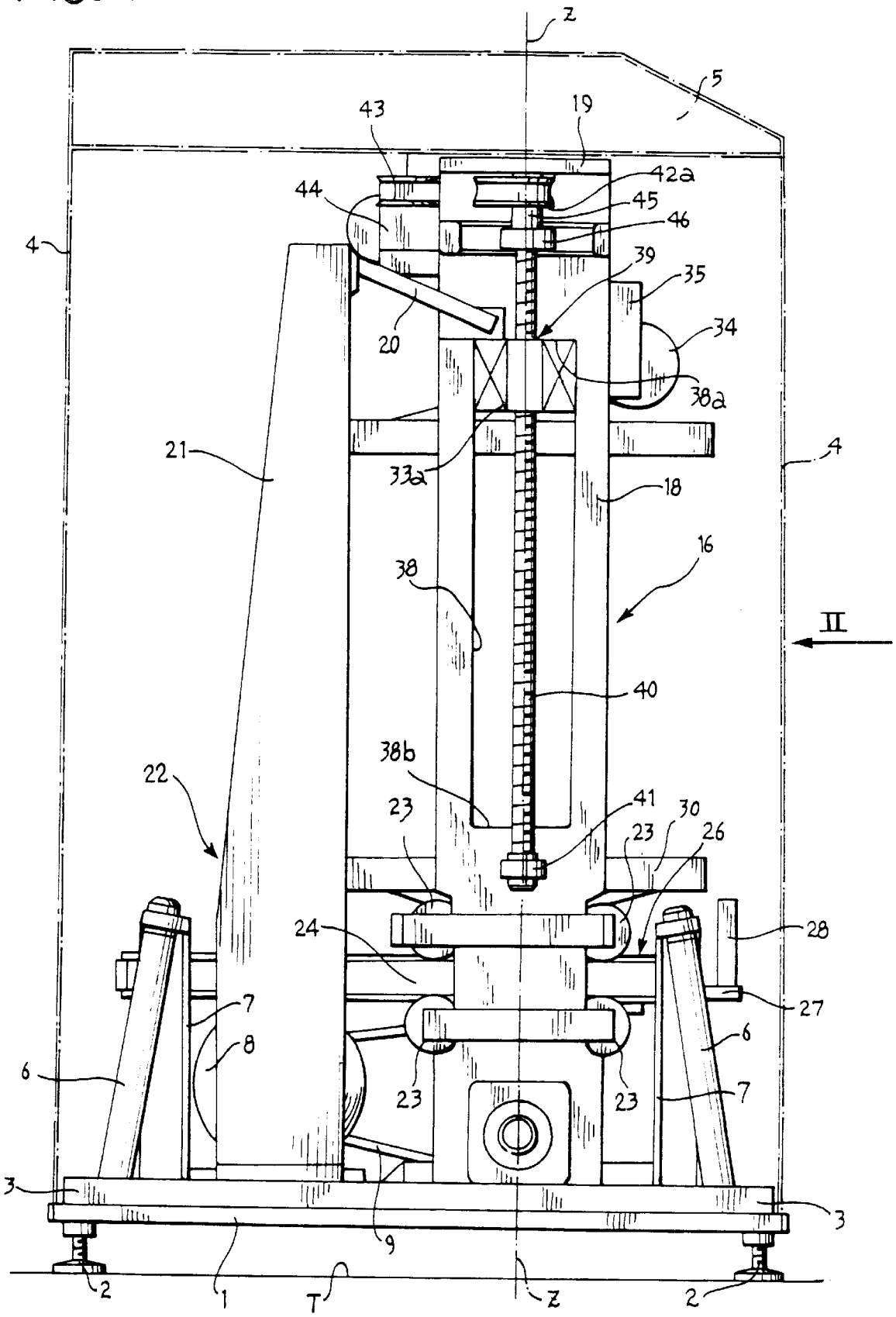
FIG. 1 is a side view of a mixing machine according to the present invention.

With reference now to the drawings, a mixing machine comprises a substantially quadrangular base 1 which rests on the ground T by means of four feet 2, preferably of adjustable height. The base 1 has a peripheral step 3 which defines a peripheral abutment surface for the lower edge of a casing 4 which is preferably, but not necessarily, made of a plastics material so as to be light and cheap. The casing 4 may be integral with the base 1 or, alternatively, may be fixed by means of releasable connections so that it can be removed easily, for example, for maintenance operations on the mixing machine. The upper portion of the casing 4 comprises a hinged lid 5 which can be opened to provide access to the upper portion of the mixing machine, for example, for maintenance operations. The front wall 5*a* of the lid 5 is inclined and can serve as a support for a control panel (not shown in the drawing). At the front of the machine, the casing has an opening (not shown in the drawing) which provides access from outside to the region for the loading and unloading of a container containing the fluid to be mixed, as will become clearer from the following. The front opening of the casing is closed by a door which has a protective function and is preferably made of transparent material so that the operator can check the operation of the mixing machine visually. The door is preferably associated with sensors for detecting the closed and open conditions thereof as well as a lock bolt, preferably operated by means of an automatic device, for example, an electromagnet, to prevent opening of the door during the operation of the mixing machine.

Four suspension units 6 of generally known type are mounted near the four respective corners of the base 1 and each comprises, for example, a resilient element and a viscous damper and are preferably inclined to the vertical and directed inwardly of the mixing machine. Four brackets 7 for supporting an outer frame 22 on the base of which a main electric motor 8 is mounted are fixed to the upper ends of the suspension units 6. In the appended drawings, the base of the outer frame 22 is hidden by the base 1 which, for reasons of economy and size, and without in any way detracting from its mechanical strength, has a large, inner, quadrangular opening in which the cradle is housed. Naturally, a large space is provided between the base 1 and the base of the outer frame 22 to prevent interference between the two elements during the operation of the mixing machine.

Figure 2:
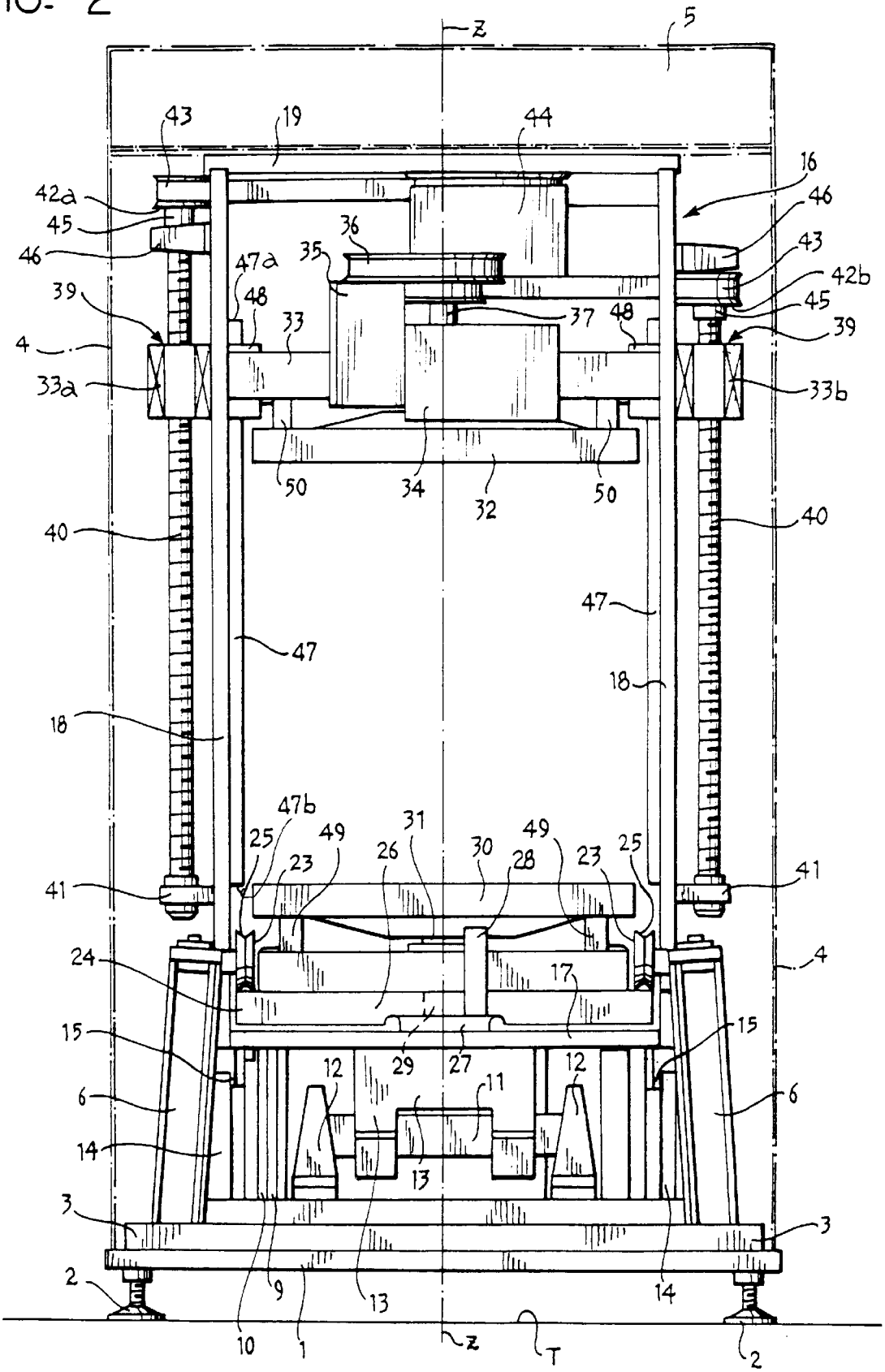
FIG. 2 is a front view of the mixing machine of FIG. 1, taken on the arrow II.

A pulley is keyed to the output shaft of the main motor 8 and is connected, by means of one or more transmission belts 9, preferably of trapezoidal type, to a second pulley 10 (see FIG. 2) which in turn is keyed to a shaft 11 supported for rotation by two bearings 12 fixed to the base of the cradle. A counterweight 13 is mounted on the shaft 11 between the two bearings 12, its centre of gravity being spaced from the axis of the shaft 13 for reasons which will become clearer from the following.

Two discs 14 fixed to the ends of the shaft 11 carry two pins 15 lying on a common axis parallel to and spaced from the axis of the shaft 11. The two pins are connected to the lower portion of an inner frame 16 comprising a lower cross-member 17, two side members 18, and an upper cross-member 19. One end of a connecting rod 20 is articulated to the upper portion of each side member 18, its other end being articulated to the upper portion of a respective side 21 of the outer frame 22.

Four idle guide wheels 23 with substantially horizontal axes of rotation, mounted near the lower portion of each side member 18 are arranged in opposed pairs relative to a transverse bar 24 which can thus move horizontally in the direction of its length, rolling on the four wheels 23. The guide wheels 23 have respective annular grooves 25 along their peripheral surfaces for guiding the edges of each of the two transverse bars 24 during the sliding movement of the bars. The two transverse bars 24 form part of a small frame 26 to the front of which a lever 27, operable by means of a grip 28, is connected for pivoting about a vertical axis. On the opposite side to the grip 28, the lever 27 has an engagement tooth (not shown in the drawings) for engaging on a vertical pin 29 fixed to the lower cross member 17 of the inner frame 16. A spring keeps the lever 27 pressed towards the pin 29 so as to clamp the small frame 26 to the lower cross member 17 in the operative condition of the mixing machine, as will be described further below. In a preferred embodiment, pairs of wheels 23 disposed on the same side of the transverse bars 24, for example, the upper pairs of wheels, are mounted on the inner frame 16 in an adjustable manner so that their vertical positions can be adjusted, for example, during the checking or maintenance of the machine, so as to adapt to the widths of the transverse bars 24 in dependence on working tolerances or wear, eliminating any play, which would be harmful in the mixing process, whilst maintaining an adequate overall ability of the small frame 26 to slide on the guide wheels 23.

A support plate 30 mounted on the small frame 26 is freely rotatable on a vertical pin 31, the axis of which substantially coincides with a vertical axis Z—Z when the mixing machine is in the activated condition in which the small frame 26 is clamped to the cross member 17. Two support wheels 49 mounted in diametrally-opposed positions with respect to the pin 31 near the circular edge of the lower surface of the support plate 30, are freely rotatable on respective transverse shafts (not shown in the drawing) fixed to the small frame 26. The wheels 49 support the plate 30 as it rotates about the pin 31. Naturally, a different number and arrangement of wheels 49 around the pin 31 may be provided, for example, by the provision of three wheels spaced angularly by 120° in a horizontal plane.

An upper plate 32 disposed opposite the lower plate 30 is mounted for rotating about the vertical axis Z—Z on a transverse clamping structure 33. Support wheels 50, also provided on the transverse structure 33 in exactly the same manner as described with reference to the lower support plate 30 and mounted for rotating freely on transverse shafts fixed to the transverse structure, are intended to roll on the upper surface of the upper support plate 32 in order to distribute its loading due to the clamping of the container and to allow it to rotate about the axis Z—Z. The angular arrangement and number of wheels 50 may be selected to match those of the wheels 49 or may differ therefrom. A secondary electric motor 34 is also fixed to the transverse structure 33 and is connected, by means of a reduction unit 35 and a pulley and belt transmission 36, to a drive shaft 37 for rotating the upper plate 32.

The lateral ends 33*a*, 33*b* of the transverse structure project from the inner frame 16 through two vertically elongate openings 38, one formed in each side member 18.

Near the lateral ends 33*a*, 33*b* of the transverse structure 33, two threaded bushes 39 are engaged on respective driving screws 40 which extend vertically outside the lateral shoulders 18 and are mounted rotatably on respective supports 41 projecting outwardly from each side member 18 below the opening 38. A respective pulley 42*a*, 42*b*, keyed to the upper end of each driving screw 40, is connected to an electric driving motor 44 by means of a respective belt 43, preferably with the interposition of a reduction unit. The driving screws 40, the pulleys 42*a*, 42*b*, the respective transmission members and the electric driving motor 44 are all mounted on the inner frame 16. In particular, the motor 44 is mounted adjacent the upper cross member 19. The driving screws 40 have upper cylindrical, non-threaded portions 45 which are supported for rotation by two bearings 46 projecting laterally from the upper portions of the side members 18. The rotation of the driving screws 40 alternatively clockwise or anticlockwise by the operation of the driving motor 44 causes the transverse structure 33 to move vertically in one direction or in the other. The upper side 38*a* and the lower side 38*b* of each opening 38 act as respective upper and lower mechanical stop abutments for the movement of the transverse structure 33.

A respective guide bar 47 is also fixed to each side member 18, its upper and lower ends 47*a* and 47*b* being clamped near the upper and lower sides 38*a* and 38*b* of the opening 38, respectively. Two guide bearings or bushes 48, mounted inside the transverse structure 33 in through-holes having vertical axes coinciding with the axes of the guide bars 47, are coupled for sliding vertically on the guide bars 47.

The guide bars react to absorb the forces oriented in directions other than along the axis of movement of the transverse structure 33 which carries upper clamping plate 32 to protect the driving screws 40 from such forces.

The electric motors 8, 34, 44, the sensors and the lock bolt associated with the door provided in the casing 4 are connected electrically to an electric control and supply unit (not shown in the drawings), mounted inside the casing 4, preferably in the upper region which is accessible through the hole in the cover 5. The control unit preferably comprises an electronic system for regulating, controlling and checking the operation of the mixing machine and is interfaced with an indicator and control panel accessible from outside. The control unit may also be interfaced with an external processing system in order to form complex and automated systems for the production of fluid products. The characteristics of the control unit do not form a subject of the present invention and will not therefore be described further below since, in any case, control units capable of activating and regulating the operation of a mixing machine according to the present invention are generally known to experts in the art.

To operate the mixing machine according to the present invention, a substantially cylindrical container containing the fluid products to be mixed is positioned on the lower support plate 30 after this has been partially extracted from the mixing machine through the front opening formed in the casing 4 by the movement of the small frame 26 the lateral bars 24 of which are guided by the idle wheels 23. In particular, the small frame 26 is released by an operator who acts on the grip 28, disengaging the lever 27 from the pin 29. After the container has been positioned on the lower plate 30, the operator pushes the small frame 26 towards the interior of the mixing machine until the lever 27 snap-engages on the pin 29. As a result of the closure of the front door of the machine, the sensors which detect its closure supply a first consent signal for the activation of the mixing process. When a second consent signal is supplied directly by an operator or by a processing system interfaced with the control unit of the machine, the mixing process is activated on the basis of operative parameters input by the operator, supplied by the external processing system or otherwise derived automatically according to techniques generally known in the art.

First of all, the locking device or lock bolt of the front door is activated, after which the electric driving motor 44 is supplied and sets the driving screws 40 in rotation, for example, clockwise, so as to lower the transverse structure 33 and consequently the upper plate 32. When the upper plate 32 reaches the upper portion of the container of fluids to be mixed, the control unit detects the clamping force on the container, for example, by detecting the current absorbed by the electric motor 44 and de-energizes it when the clamping force has reached a predetermined threshold, for example, selected according to the buckling resistance characteristics of the container and the overall mass of the container and of the fluids.

After the driving motor 44 has been de-energized, the main motor 8 and the secondary motor 34 are activated so as to bring about a combined mixing motion consisting of the oscillation or vibration of the inner frame 16 relative to the outer frame 22 and of the rotation of the container about the vertical axis Z—Z, for example, according to the method of operation described in the Applicant's European patent application EP-0 617 998 cited above. Upon completion of the mixing procedure, the motors 8 and 34 are de-energized and the control unit releases the lock bolt closing the front door. The operator can then extract the small frame 26 in the manner described above.

The principles of the invention can be applied more generally, in exactly the same manner as described above with reference to a so-called vibration mixer, in any type or model of mixer or agitator for mixing or amalgamating products disposed in one or more containers with particular but not limiting reference to mixers using a different, for example, gyroscopic mixing principle.

Moreover, a support and clamping unit formed according to the principles of the present invention can be used in machines of types generally used for handling containers of products which are moved along a certain path or the positions of which have to be maintained securely, particularly but not exclusively, on machines for dispensing dyes into a container, or in systems for moving containers on a production line for paints, varnishes and the like.

Naturally, the principle of the invention remaining the same, the forms of embodiment and details of construction may be varied widely with respect to those described above, with particular but not limiting reference to the sizes, the proportions and the geometrical shapes of the elements as well as to the materials used and to the use of equivalent components, without thereby departing from the scope of the present invention.

What is claimed is:

1. A roto-vibratory mixer for products generally disposed in a container, said mixer comprising a support structure, holding means comprising an inner frame mounted on the support structure and movable along a first predetermined path, roto-vibratory motion producing means for moving said holding means with a combined mixing motion consisting of a vibration and a rotation of the container, first and second opposed clamping members mounted on said inner frame for movement relative to the inner frame for clamping said container therebetween, at least said first clamping member being movable selectively from a first loading position, in which said container can be placed on the second clamping member, to a second operative position in clamping engagement with said container, actuator means for selectively bringing about the movement of said first clamping member on said inner frame from the first position to the second position and vice versa, and guide means distinct from the actuator means for guiding the linear sliding of the first clamping member along a first predetermined axis during movement of said first clamping member from the first position to the second position.

2. A mixer according to claim 1, wherein the first clamping member is mounted for sliding on the holding means along said first predetermined axis towards the second clamping member and the second clamping member is mounted for sliding on the holding means along a second predetermined axis substantially perpendicular to the first predetermined axis.

3. A mixer according to claim 2, wherein said guide means comprises two bars substantially parallel to the first predetermined axis, and the first clamping member comprises a pair of bushes mounted for sliding on the bars.

4. A mixer according to claim 2, wherein additional guide means are provided for guiding said second clamping member comprising at least two pairs of opposed idle wheels mounted on the holding means symmetrically with respect to the second predetermined axis, said wheels being rotatable about axes perpendicular to said second predetermined axis, and a bar-like element which is elongate along the second predetermined axis, and disposed adjacent the second clamping member in a manner such that opposed surfaces of the bar-like element constitute rolling surfaces for the opposed wheels of the pairs.

5. A mixer according to claim 4, wherein at least one of the wheels is mounted on the holding means for adjustment towards and away from an opposite wheel of the pair.

6. A mixer according to claim 1, wherein the first and second clamping members comprise, respectively, a first plate and a second plate which are rotatable about a common axis in the second operative position, and wherein a plurality of support wheels for the plates are mounted on said inner frame for free rotation about axes perpendicular to the common axis of rotation so as to roll along annular paths on surfaces of the plates perpendicular to the common axis as a result of the rotation of the plates.

7. A mixer for products generally disposed in a container, said mixer comprising a support structure, holding means mounted on the support structure for movement along a predetermined path, the holding means including first and second opposed clamping members for clamping the container, wherein at least the first clamping member is mounted for sliding on the holding means along a first predetermined axis and the second clamping member is mounted for sliding on the holding means along a second predetermined axis substantially perpendicular to the first predetermined axis, guiding means for guiding the sliding of the second clamping member, the guiding means comprising at least two pairs of idle wheels mounted on the holding means symmetrically with respect to the second predetermined axis, said wheels being rotatable about axes perpendicular to said second predetermined axis, and a bar-like element which is elongate along the second predetermined axis and is disposed adjacent the second clamping member in a manner such that opposed surfaces of the bar-like element constitute rolling surfaces for opposed wheels of said pairs of wheels.

8. A support and clamping unit for a machine for handling containers of products, wherein said support and clamping unit comprises holding means including:

at least first and second opposed clamping members which can clamp at least one of the containers, at least one of the first and second clamping members being movable, independently of the other of the first and second clamping members, selectively from a first loading position in which the at least one container can be placed on the holding means, to a second operative position in which the container is clamped between said first and second clamping members, actuator means for selectively bringing about the movement of the at least one clamping member from the first position to the second position and vice versa independently of the other clamping member, and guide means distinct from the actuator means for guiding the linear sliding of the at least one clamping member along a first predetermined axis during its movement from the first position to the second position, wherein said first clamping member is mounted for sliding on the holding means along said first predetermined axis towards the second clamping member and the second clamping member is mounted for sliding on the holding means along a second predetermined axis substantially perpendicular to the first predetermined axis, wherein said guide means for guiding the linear sliding of said first clamping member comprise two bars substantially parallel to the first predetermined axis, and the first clamping member comprising a pair of bushes slidable on the bars, and further comprising additional guide means for guiding sliding of the second clamping member, said additional guide means comprising at least two pairs of idle wheels mounted on the holding means symmetrically with respect to the second predetermined axis, said wheel being rotatable about axes perpendicular to said second axis, and a bar-like element which is elongate along the second predetermined axis and is disposed adjacent the second clamping member in a manner such that opposed surfaces of the bar-like element constitute rolling surfaces for opposite wheels of the pairs.

9. A support and clamping unit according to claim 8, wherein at least one pair of idle wheels is mounted on the holding means for adjustment towards and away from an opposite pair of idle wheels.

* * * * *